US008297470B2

(12) United States Patent
Yang et al.

(10) Patent No.: US 8,297,470 B2
(45) **Date of Patent: *Oct. 30, 2012**

(54) TRASH CAN ASSEMBLY

(75) Inventors: Frank Yang, Rancho Palos Verdes, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/859,380

(22) Filed: Aug. 19, 2010

(65) Prior Publication Data

US 2010/0308049 A1 Dec. 9, 2010

Related U.S. Application Data

(63) Continuation of application No. 11/544,786, filed on Oct. 6, 2006, now Pat. No. 7,806,285, which is a continuation of application No. 10/717,038, filed on Nov. 19, 2003, now Pat. No. 7,121,421.

(51) Int. Cl.
*B65D 43/16* (2006.01)

(52) U.S. Cl. ..... 220/845; 220/263; 220/848

(58) Field of Classification Search ..... 220/845, 220/848, 810, 844, 908.1, 908, 264, 263, 220/262; 16/381, 380

See application file for complete search history.

(56) References Cited

U.S. PATENT DOCUMENTS 3,888,406 A * 6/1975 Nippes ..... 206/554
5,230,525 A * 7/1993 Delmerico et al. ..... 280/47.131
5,265,511 A * 11/1993 Itzov ..... 83/490
6,626,316 B2 * 9/2003 Yang ..... 220/263
7,806,285 B2 * 10/2010 Yang et al. ..... 220/264

* cited by examiner

*Primary Examiner* — Stephen Castellano
(74) *Attorney, Agent, or Firm* — Donald D. Min

(57) ABSTRACT

The embodiments provide a hinge assembly for a trash can assembly that allows the lid to be conveniently removed from the hinge assembly. The trash can assembly, can comprises: a shell having an upper, open end; a lid configured to cover the upper, open end of the shell; a hinge assembly coupled to the shell and the lid and configured to provide pivotable movement of the lid between an open position and a closed position, wherein the hinge assembly comprises, a mounting bracket provided on the lid and having at least one through hole, a housing provided at the upper end of the shell and defining a bore, and a pivot bar that is received inside the at least one through hole and the bore to allow pivotable movement of the mounting bracket relative to the housing, and engaged by a locking mechanism into position within mounting bracket and housing to prevent withdrawal of the pivot bar from inside the at least one through hole and the bore.

12 Claims, 17 Drawing Sheets

TRASH CAN ASSEMBLY

RELATED APPLICATIONS

The present application is a continuation of application Ser. No. 11/544,786 filed on Oct. 6, 2006, now U.S. Pat. No. 7,806,285 which is a continuation of application Ser. No. 10/717,038, filed on Nov. 19, 2003, now U.S. Pat. No. 7,121, 421.

FIELD

The present invention relates to household items, and in particular, to a trash can assembly that incorporates a number of improvements and enhancements.

BACKGROUND

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can. The foot pedal is operatively connected to the lid by a link rod, so that a user can step on the foot pedal to open the lid of the trash can, thereby freeing up the user's hands to toss trash, or to change the plastic liner or bag that is used to line the trash can. Other trash cans have even provided an interior metal or plastic liner that fits inside the outer shell of the trash can, and which can be removed to be washed. However, these conventional trash cans still suffer from a number of drawbacks.

For example, the foot pedals on some of the conventional trash cans are noisy to use. In particular, stepping on a foot pedal of a conventional trash can often result in a loud banging noise as the lid is opened, and releasing the step on the foot pedal will also result in another loud banging noise as the lid slams shut under the force of gravity. These banging actions also result in wear and tear to the contacting parts.

Other problems are associated with the hinge assembly that hinges the lid to the outer shell of the trash can. In most conventional trash cans, the link rod extends through a portion of the interior of the outer shell, and then extends along a portion of the exterior of the outer shell adjacent the lid. As a result, the hinge assembly of most conventional trash cans tend to be quite large and bulky. A large and unwieldy hinge assembly makes it difficult to position the trash can at certain locations (e.g., corners, or against walls) in the house, and forces the manufacturer to use packing boxes that are larger than desired.

In addition, it is sometimes desirable to be able to remove the lid on a trash can and replace it with a new lid. For example, the lid may be damaged (e.g., the lid may get dented by objects), and it would be more cost-efficient to be able to salvage the outer shell of the trash can and merely replace the lid. Unfortunately, most conventional trash cans either do not allow for a pivoting lid to be replaced, or have hinge assemblies that make it very difficult and inconvenient to remove and replace a lid.

Thus, there remains a need for a trash can that overcomes the drawbacks identified above.

SUMMARY OF THE DISCLOSURE

It is an object of the present invention to provide a trash can assembly that reduces noise and wear when the step pedal is actuated to open and close the lid.

It is another object of the present invention to provide a hinge assembly for a trash can assembly that has a low profile.

It is yet another object of the present invention to provide a hinge assembly for a trash can assembly that allows the lid to be conveniently removed from the hinge assembly.

In an embodiment, a trash can assembly, comprises: a shell having an upper, open end; a lid configured to cover the upper, open end of the shell; a hinge assembly coupled to the shell and the lid and configured to provide pivotable movement of the lid between an open position and a closed position, wherein the hinge assembly comprises, a mounting bracket provided on the lid and having at least one through hole, a housing provided at the upper end of the shell and defining a bore, and a pivot bar that is received inside the at least one through hole and the bore to allow pivotable movement of the mounting bracket relative to the housing, and engaged by a locking mechanism into position within mounting bracket and housing to prevent withdrawal of the pivot bar from inside the at least one through hole and the bore.

In accordance with an embodiment, a method of exchanging a lid on a trash can is provided. The trash can comprises a shell having an upper, open end, a lid configured to cover the upper, open end of the shell, a hinge assembly coupled to the shell and the lid and configured to provide pivotable movement of the lid between an open position and a closed position, wherein the hinge assembly comprises a mounting bracket provided on the lid and having at least one through hole, a housing provided at the upper end of the shell and defining a bore, and a pivot bar that is received inside the at least one through hole and the bore to allow pivotable movement of the mounting bracket relative to the housing, and engaged by a locking mechanism into position within mounting bracket and housing to prevent withdrawal of the pivot bar from inside the at least one through hole and the bore. The method comprises: disengaging the locking mechanism; removing the pivot bar from the at least one the through hole and the bore; removing the lid from the hinge assembly; providing a second lid into the hinge assembly; inserting the pivot bar through the at least one through hole and the bore; and engaging the locking mechanism into a position that prevents the locking bar from withdrawing from the inside of the at least one through hole and the bore.

BRIEF DESCRIPTION OF THE DRAWINGS

The accompanying drawings, which are incorporated in and constitute a part of this specification, illustrate embodiment of the invention and together with the description, serve to explain the principles of the invention.

DESCRIPTION OF THE EMBODIMENTS

Figure 1:
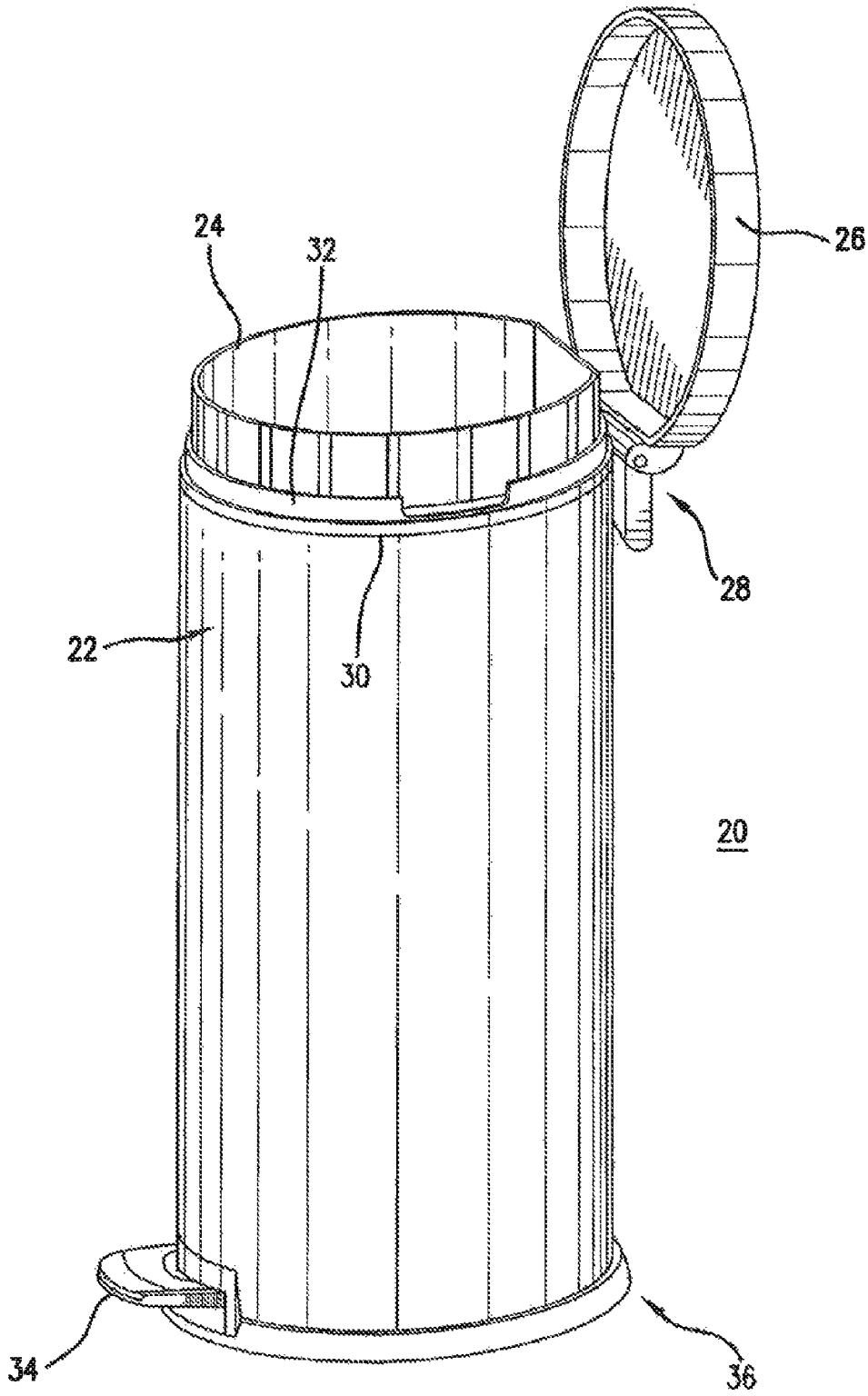
FIG. 1 is a perspective view of a trash can assembly according to one embodiment of the present invention shown with the lid open.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1-4 illustrate one embodiment of a trash can assembly 20 according to the present invention. The assembly 20 has an outer shell 22 and an inner liner 24 that is adapted to be retained inside the outer shell 22.

The outer shell 22 can have any desired configuration, including a circular shape, an oval shape, or a four-sided shape that has four side walls, among others. The inner liner 24 can have the same, or different, shape as the outer shell 22. The lid 26 is hingedly connected to a hinge assembly 28 that is positioned at the rear of the outer liner 22 adjacent a generally annular upper support frame 32 that is provided along the upper edge 30 of the outer shell 22. The outer shell 22 and its lid 26 can be made of a solid and stable material, such as a metal. The upper support frame 32 can be secured to the top edge 30 of the outer shell 22, and can be provided in a separate material (e.g., plastic) from the outer shell 22.

A foot pedal 34 is provided on the outer shell 22 adjacent the base 36 of the outer shell 22. The foot pedal 34 is secured to a front end of a pedal bar 38 (see FIG. 4) that is housed inside the base 36. The pedal bar 38 is made of a material (e.g., metal) that carries some weight, and extends from the foot pedal 34 along the base 36 and is then pivotably coupled to a link rod 40 that extends upwardly along the interior of the rear of the outer shell 22 to connect the lid 26 via the hinge assembly 28 (see FIG. 3). The pedal bar 38 and the link rod 40 operate to translate an up-down pivot motion of the pedal 34 to an up-down pivot motion for the lid 26. Each of these components will be described in greater detail hereinbelow.

Figure 2:
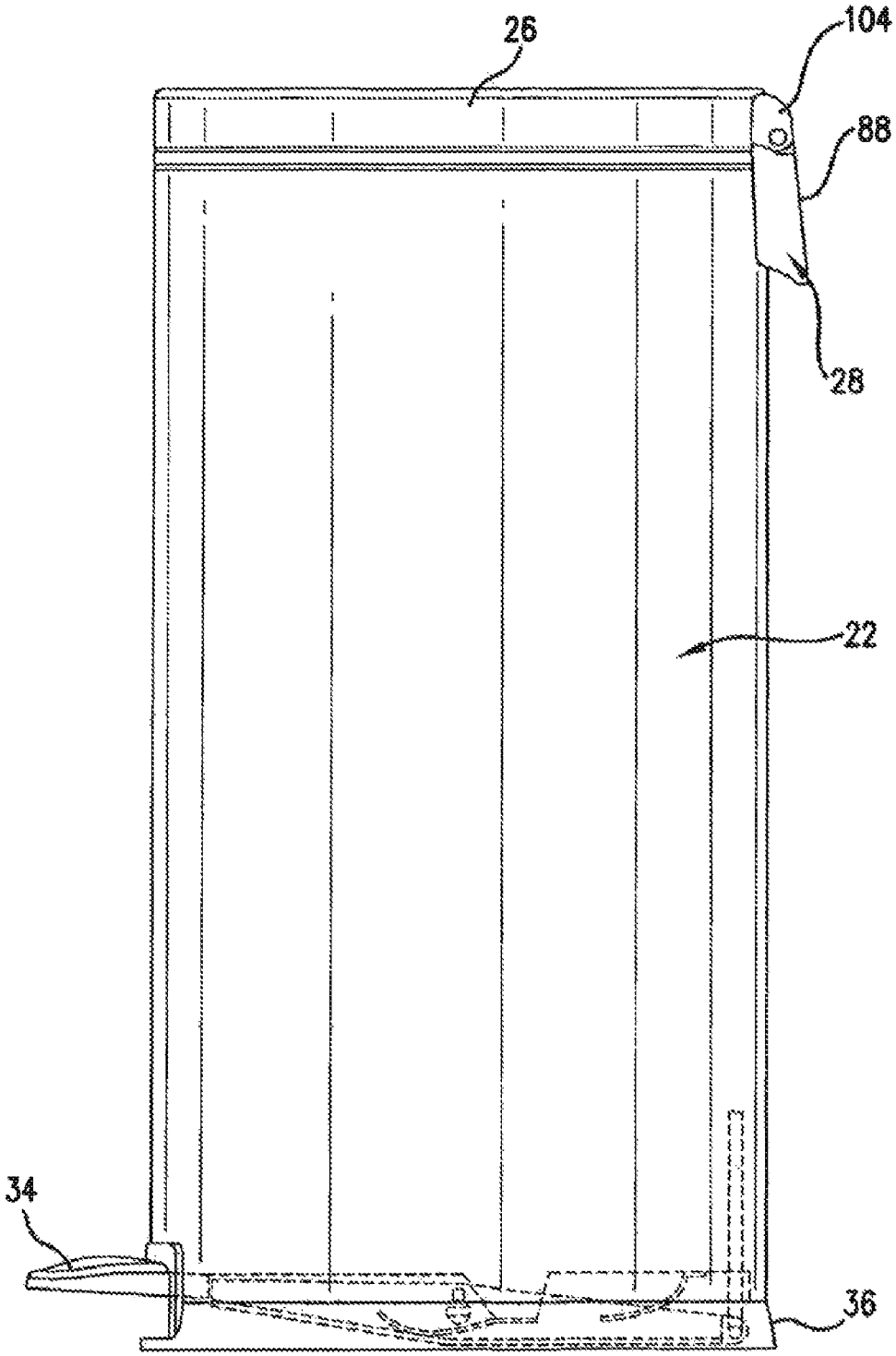
FIG. 2 is a side plan view of the trash can assembly of FIG. 1.
Figure 3:
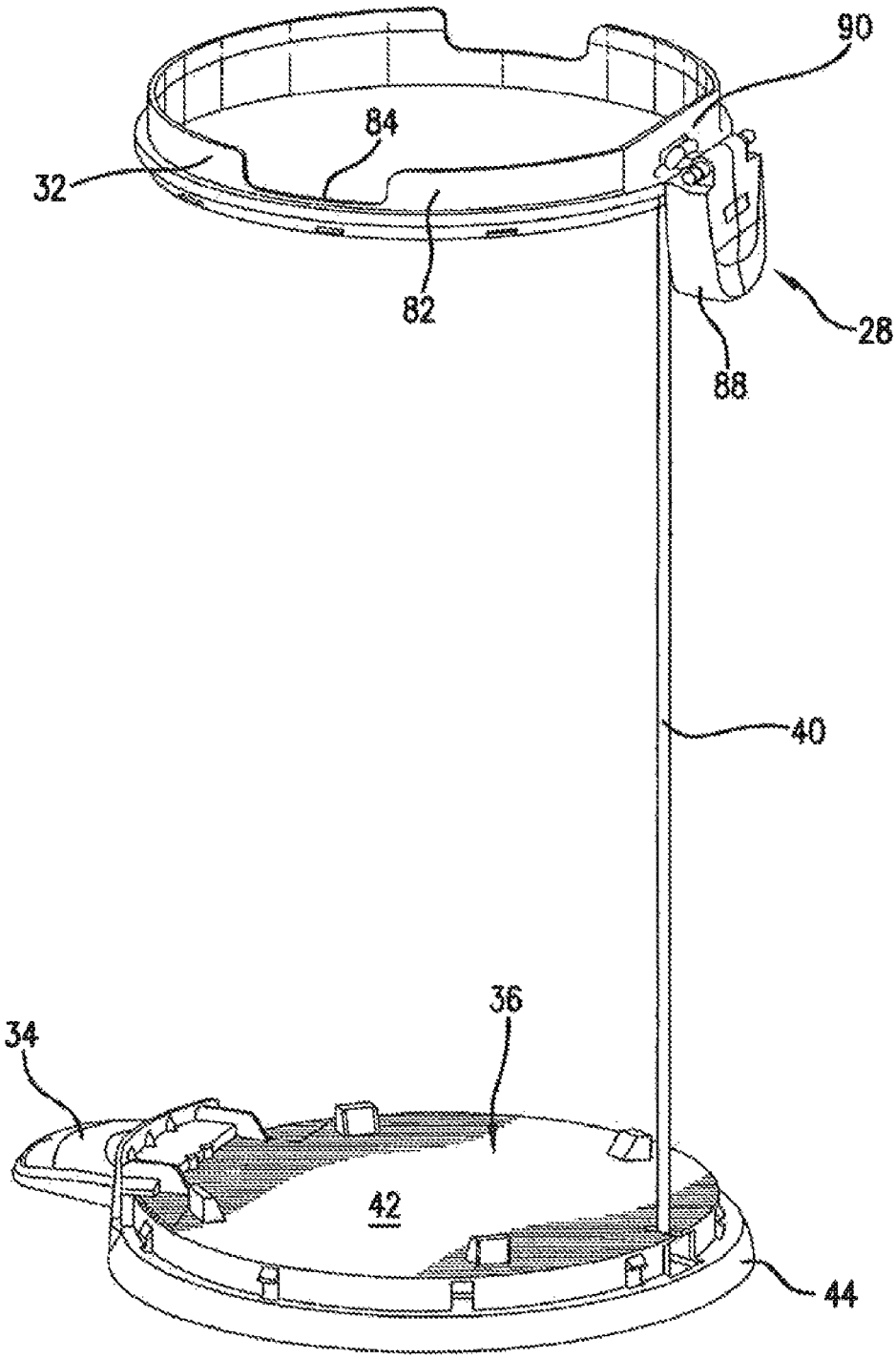
FIG. 3 is a perspective skeletal view illustrating certain components of the trash can assembly of FIG. 1.
Figure 4:
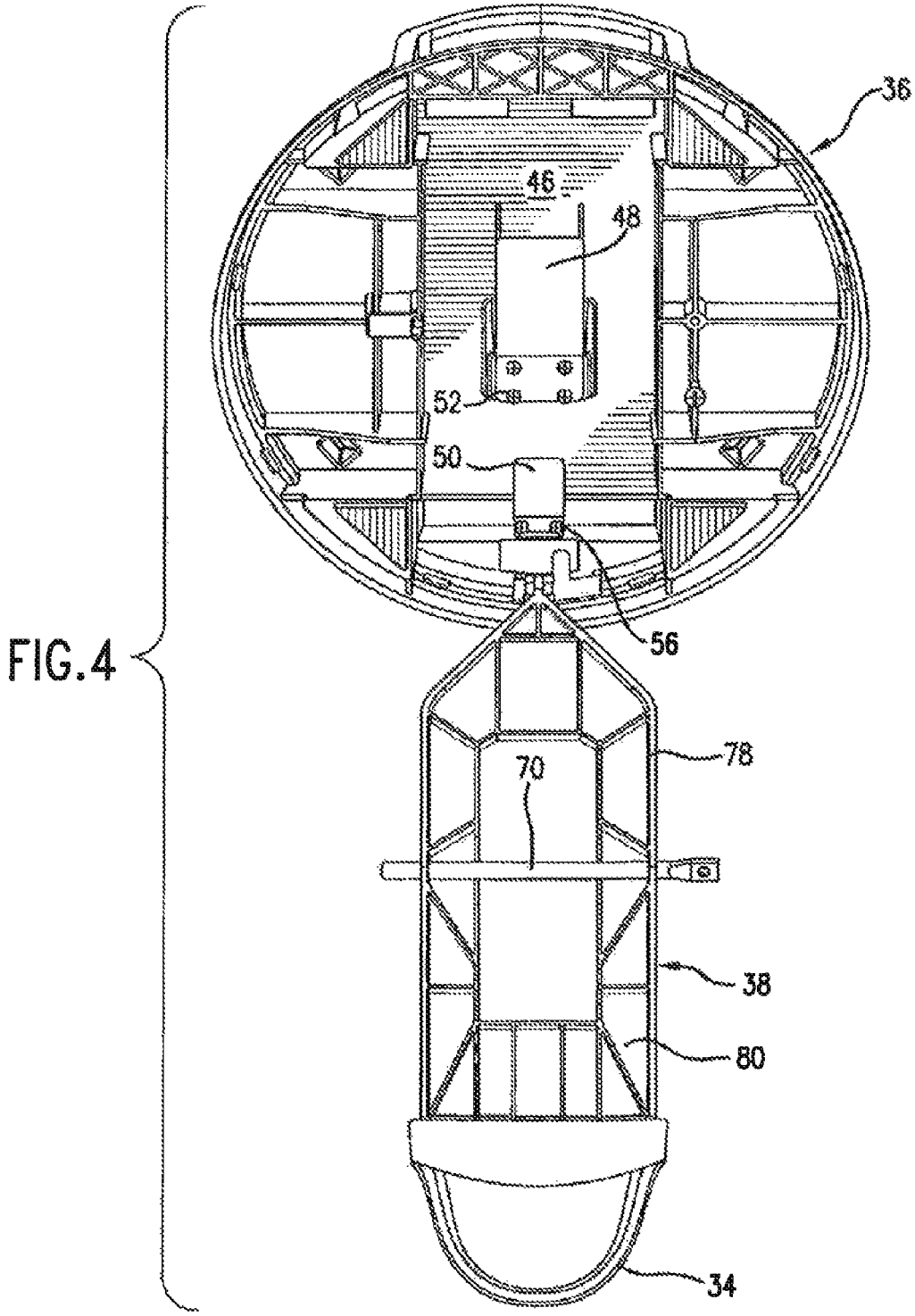
FIG. 4 is a bottom plan view of the trash can assembly of FIG. 1 shown with the base exposed and the pedal bar pivoted away from the base.
Figure 5:
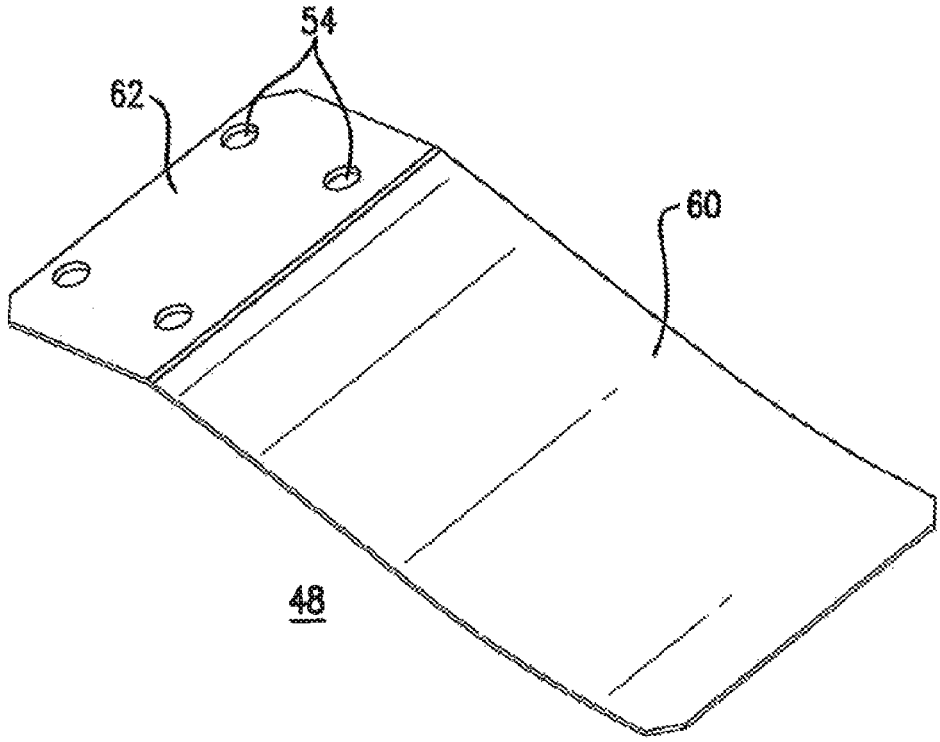
FIG. 5 is an enlarged perspective view of the first elastic element that is used in connection with the pedal bar for the trash can assembly of FIG. 1.
Figure 6:
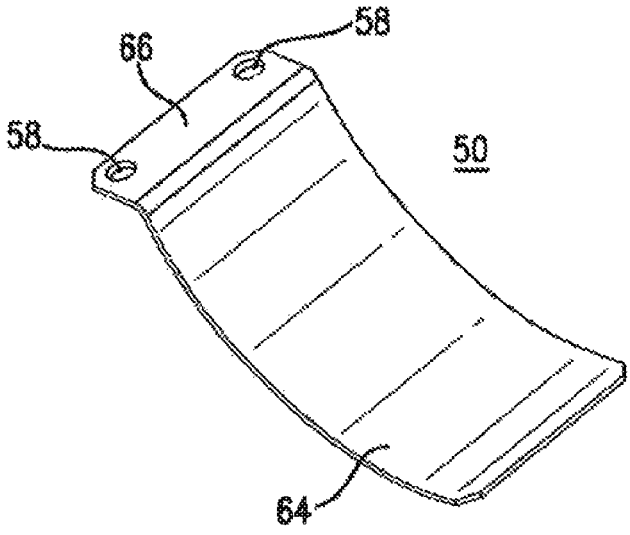
FIG. 6 is an enlarged perspective view of the second elastic element that is used in connection with the pedal bar for the trash can assembly of FIG. 1.

Referring now to FIGS. 3-6, the base 36 has a raised or domed base panel 42 and a skirt or flange portion 44 that extends from the base panel 42. A ramp 46 is formed on the bottom surface of the base panel 42. In one embodiment of the present invention, the base panel 42 and the skirt 44 can be formed in one plastic piece. The pedal bar 38 is retained under the base panel 42 and inside the skirt 44. In particular, the pedal bar 38 is pivotably connected to the ramp 46 by a fulcrum shaft 70, which extends through the pedal bar 38 at about the center of the pedal bar 38. The rear of the pedal bar 38 is pivotably connected to the bottom end of the link rod 40 by a hook 72 that is provided at the bottom end of the link rod 40 (see FIGS. 7A-7E). Thus, the pedal bar 38 can be pivoted between two positions, a first rest position (where the lid 26 is closed) as shown in FIGS. 1, 2 and 7A where the pedal 34 is at a vertically higher position than the rear of the pedal bar 38, and a second open position (where the lid 26 is opened) as shown in FIG. 7E where the pedal 34 is pressed to a vertically lower position than the rear of the pedal bar 38.

Figure 8:
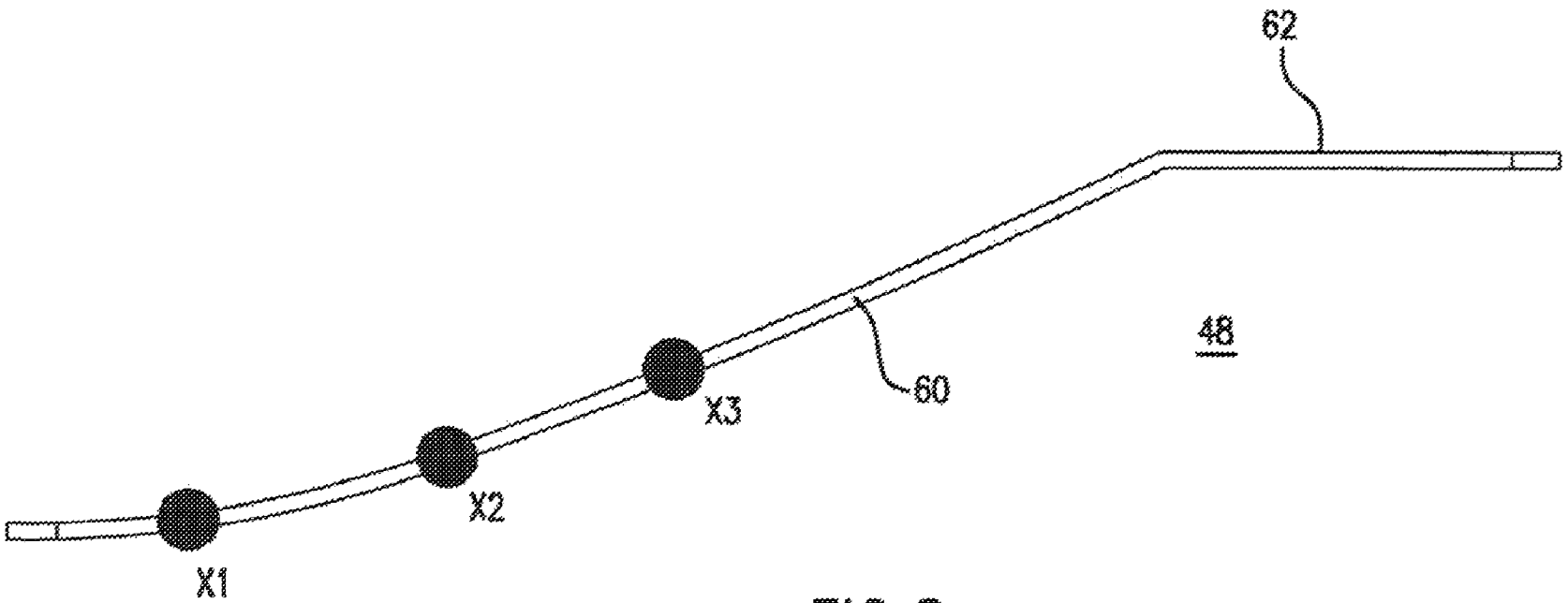
FIG. 8 is a side plan view of the first elastic element illustrating the relative positions of the locations "1", "2" and "3" referred to in FIGS. 7D, 7C and 7B, respectively.

A first elastic element 48 is provided at about the center of the ramp 46, and a second elastic element 50 is provided at the rear of the ramp 46 adjacent the link rod 40. Each elastic element 48, 50 can be made of an elastic material such as metal, wire or a sheet. The first elastic element 48 can be larger than the second elastic element 50, although the size and shapes of the elastic elements 48, 50 can be varied. The first elastic element 48 has a curved portion 60 extending from a flat portion 62. The curvature of the curved portion 60 is best illustrated in FIG. 8. A plurality of bolts 52 are inserted through openings 54 in the flat portion 62 and used to secure the first elastic element 48 to the ramp 46 in a manner such that the curved portion 60 extends away from the ramp 46 towards the pedal bar 38. Similarly, the second elastic element 50 has a curved portion 64 extending from a flat portion 66. A plurality of bolts 56 are inserted through openings 58 in the flat portion 66 of the second elastic element 50 and used to secure the second elastic element 50 to the ramp 46 in a manner such that the curved portion 64 extends away from the ramp 46 towards the pedal bar 38.

Figure 12A:
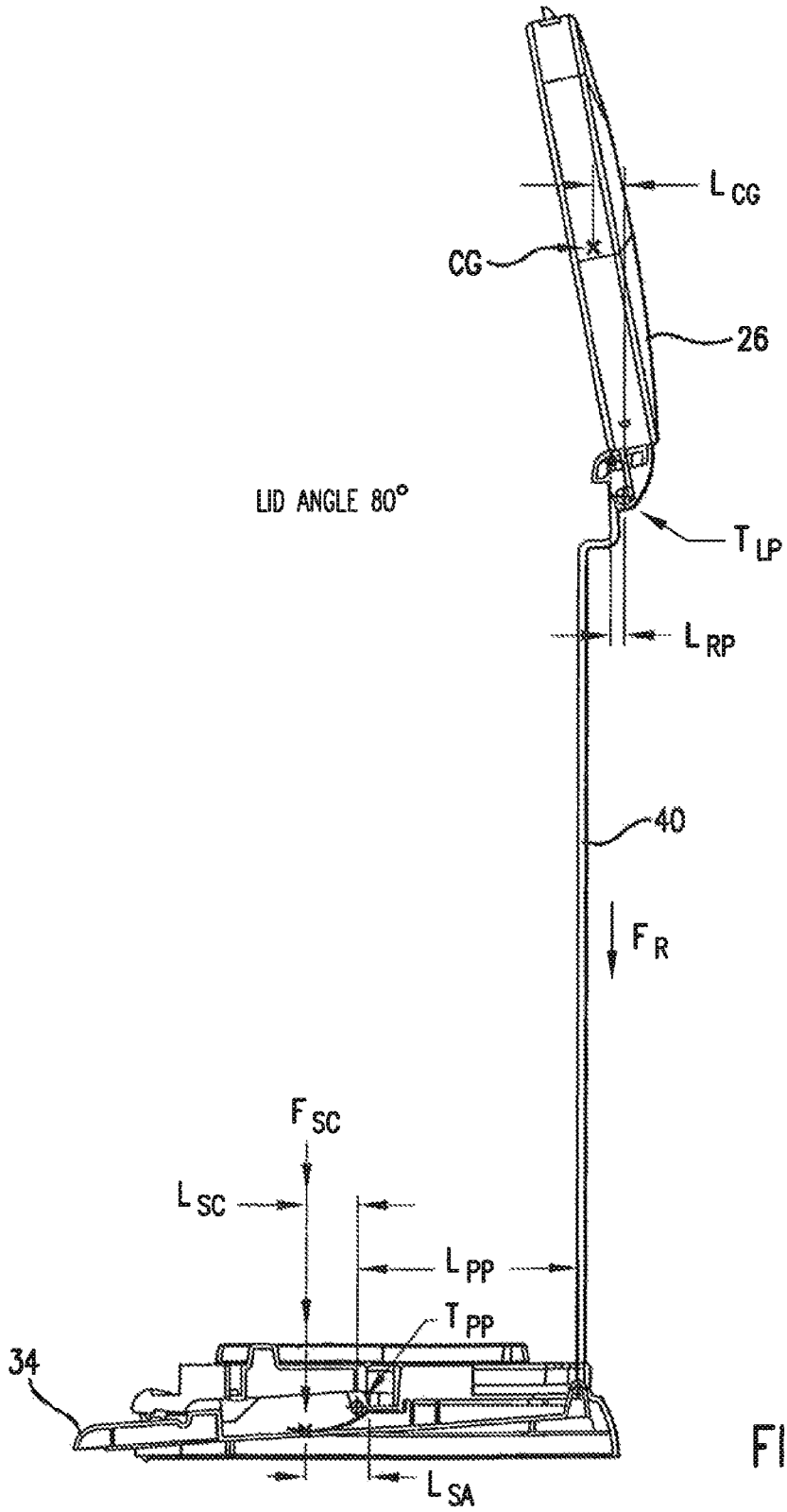
FIGS. 12A-12C illustrate the forces exerted by the lid and the first elastic element during the closing motion of the lid.
Figure 12B:
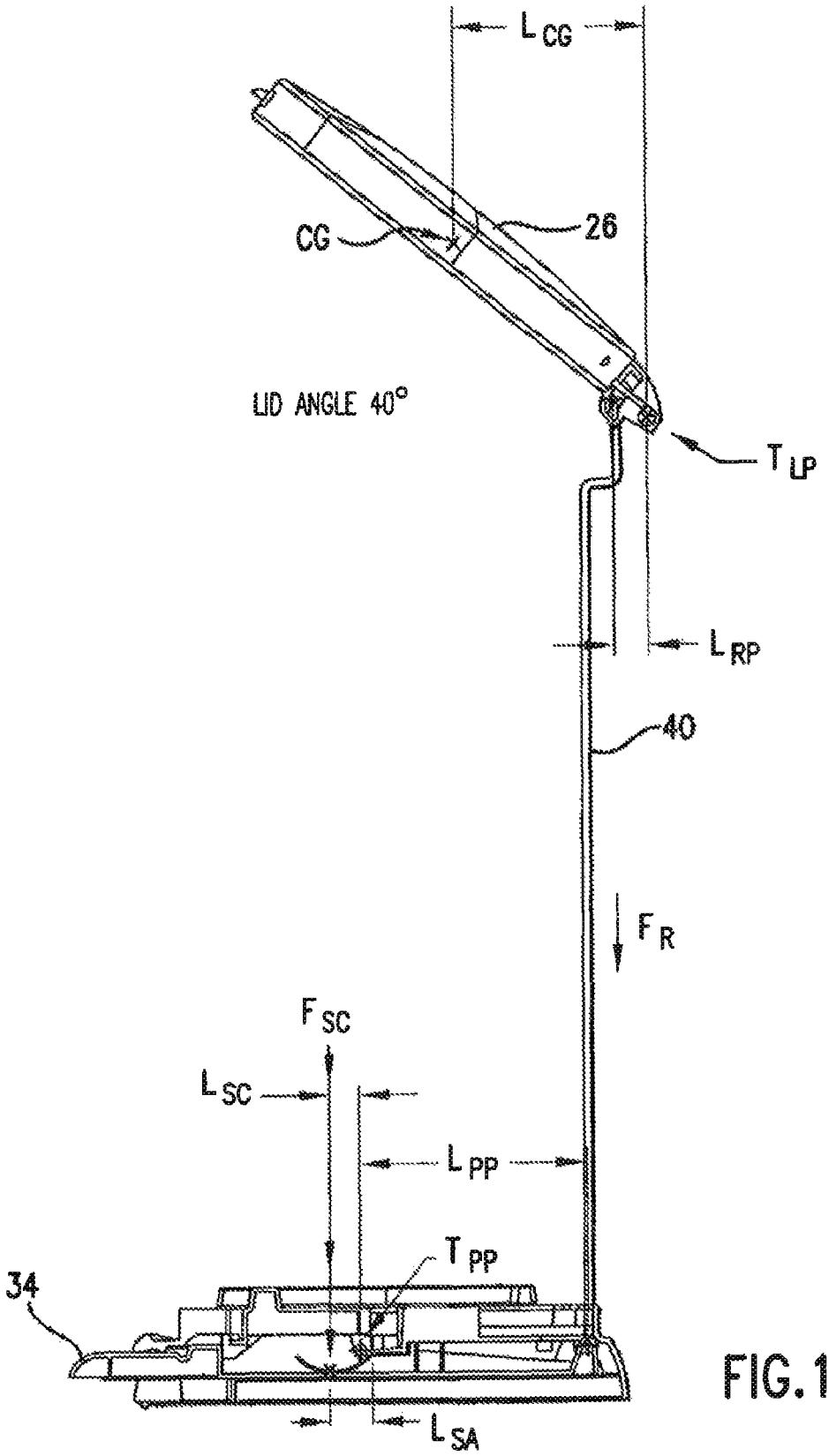
Figure 12C:
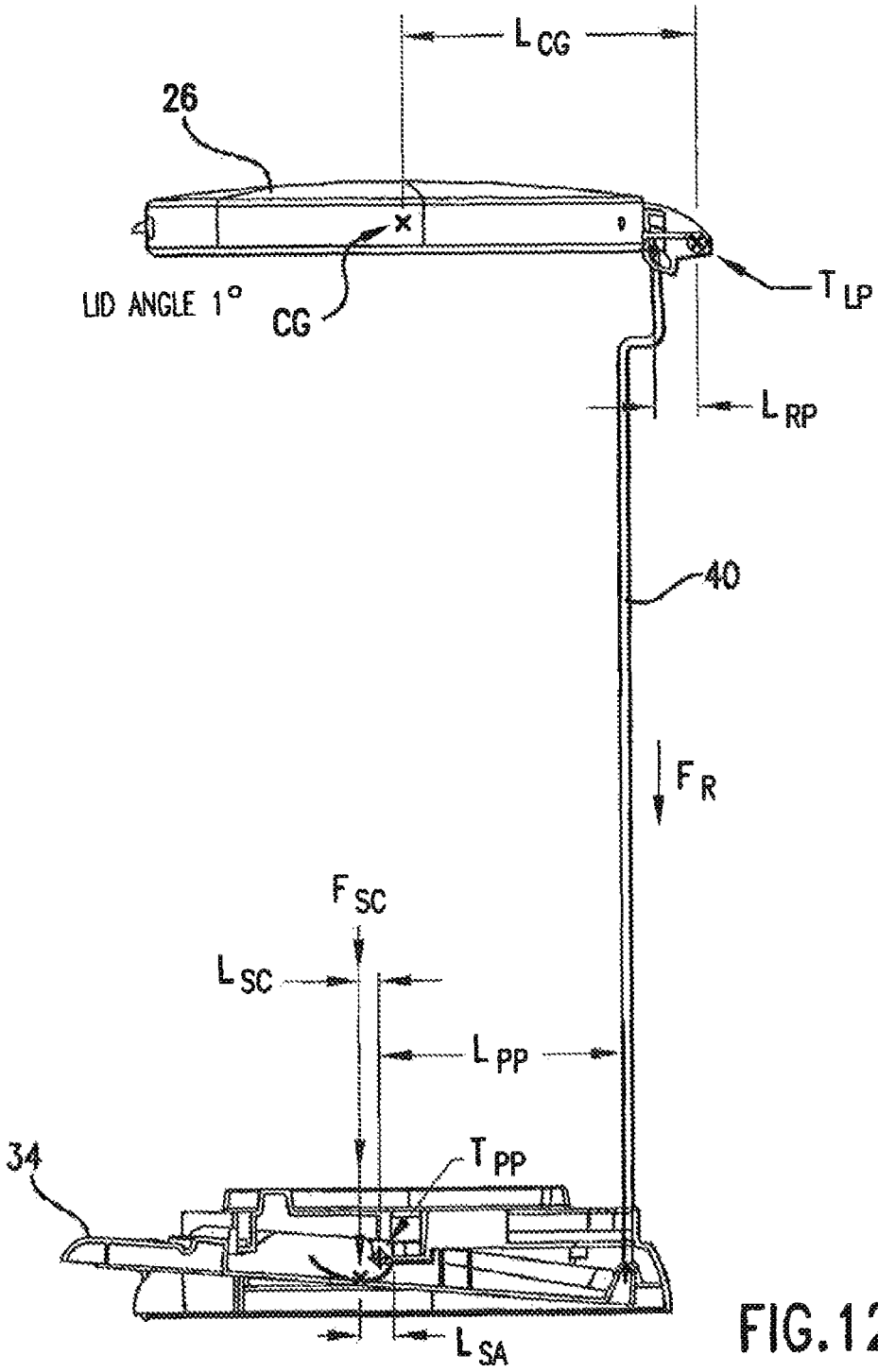

The first elastic element 48 functions to dampen the closing motion of the lid 26 so that the lid 26 can close slowly and not experience a hard slamming motion. In contrast, the second elastic element 50 functions to dampen the opening motion of the lid 26 so that the lid 26 does not experience a loud banging action during the opening of the lid 26. FIGS. 7A-7E illustrate the damping operations of the elastic elements 48 and 50. FIG. 8 is a side plan view of the first elastic element 48 illustrating the relative positions of the locations "1", "2" and "3" referred to in FIGS. 7D, 7C and 7B, respectively. FIGS. 12A-12C illustrate the forces exerted by the lid 26 and the first elastic element 48 during the closing of the lid 26.

Figure 7A:
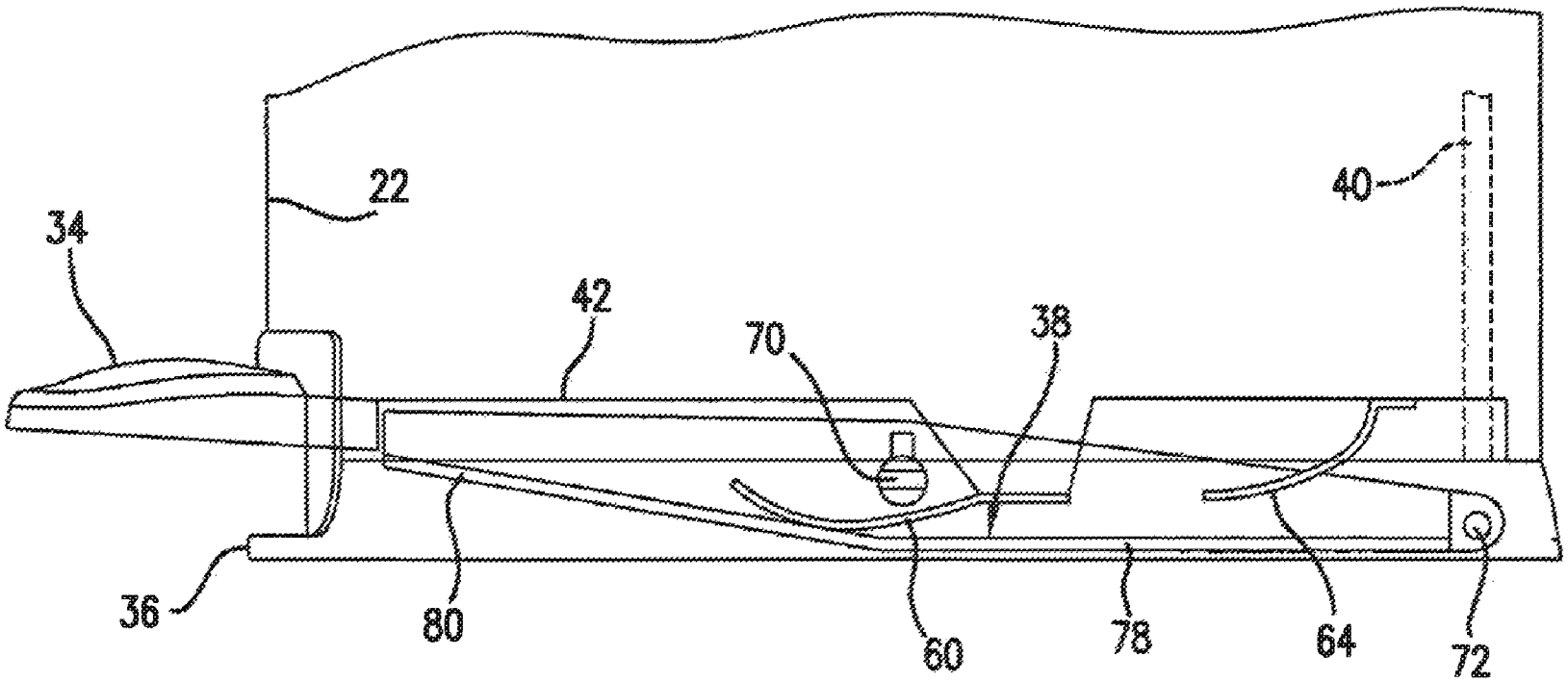
FIGS. 7A-7E illustrate the damping operations of the first and second elastic elements.

In FIG. 7A, the lid 26 is closed and the foot pedal 34 is at its highest vertical level. In this position, the rear portion 78 of the pedal bar 38 is biased by gravity and the weight of the lid 26 towards the bottom of the base 36, so that the front portion 80 of the pedal bar 38 pivots about the pivot shaft 70 and pushes the curved portion 60 of the first elastic element 48 upwardly against the normal bias of the first elastic element 48. At this time, the second elastic element 50 is spaced apart from the rear portion 78 of the pedal bar 38.

When a user steps on the pedal 34, the pedal bar 38 begins to pivot in a counterclockwise direction (when viewed from the orientation of FIGS. 7A-7E). The bias of the curved portion 60 assists in pushing the pedal bar 38 in the counterclockwise direction, so that the user does not need to exert too much force on the pedal 34. The pedal bar 38 pivots about the pivot shaft 70 until the first elastic element 48 contacts the pedal bar 38 at the location marked "3" in FIG. 7B. At this time, the second elastic element 50 is still spaced apart from the rear portion 78 of the pedal bar 38.

Figure 7B:
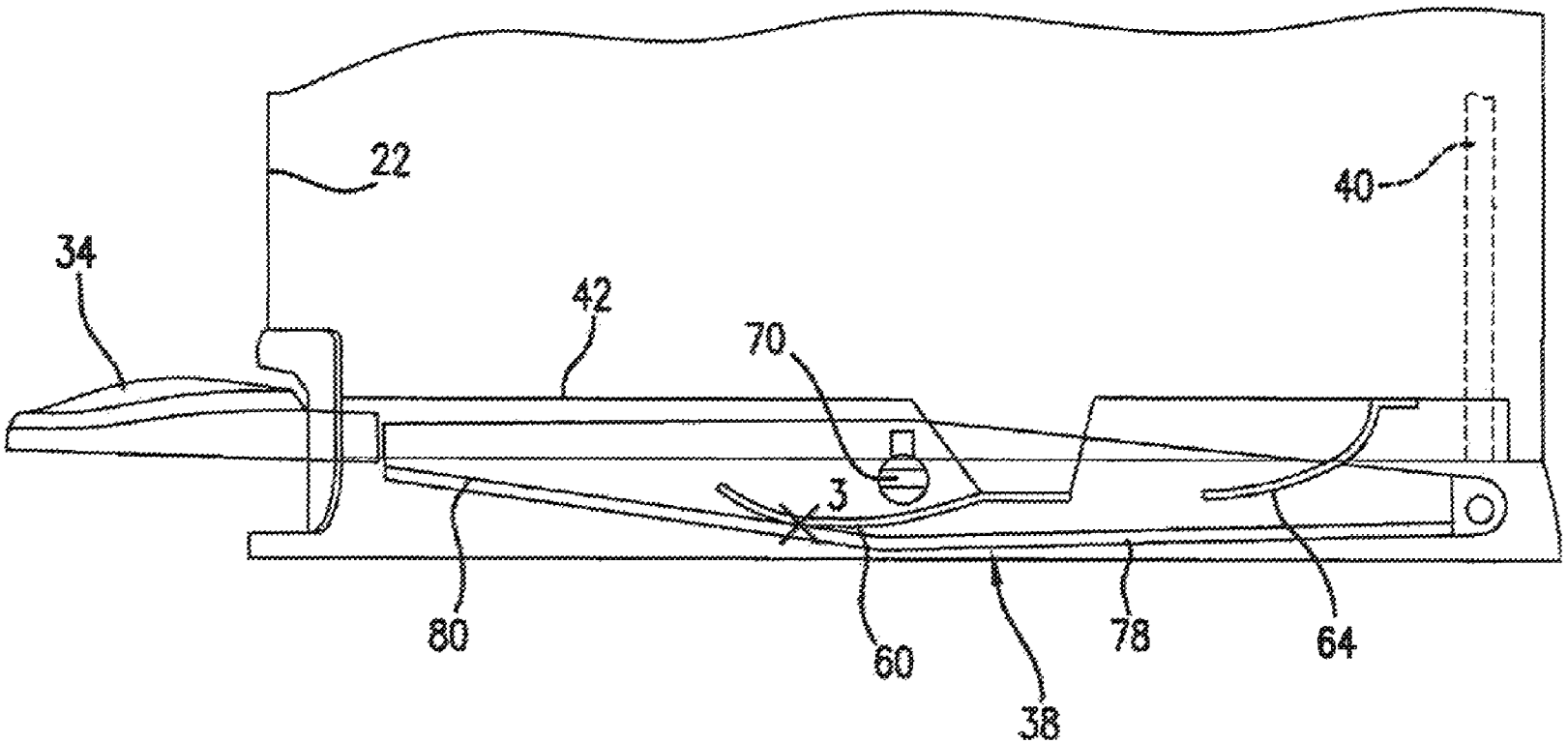
Figure 7C:
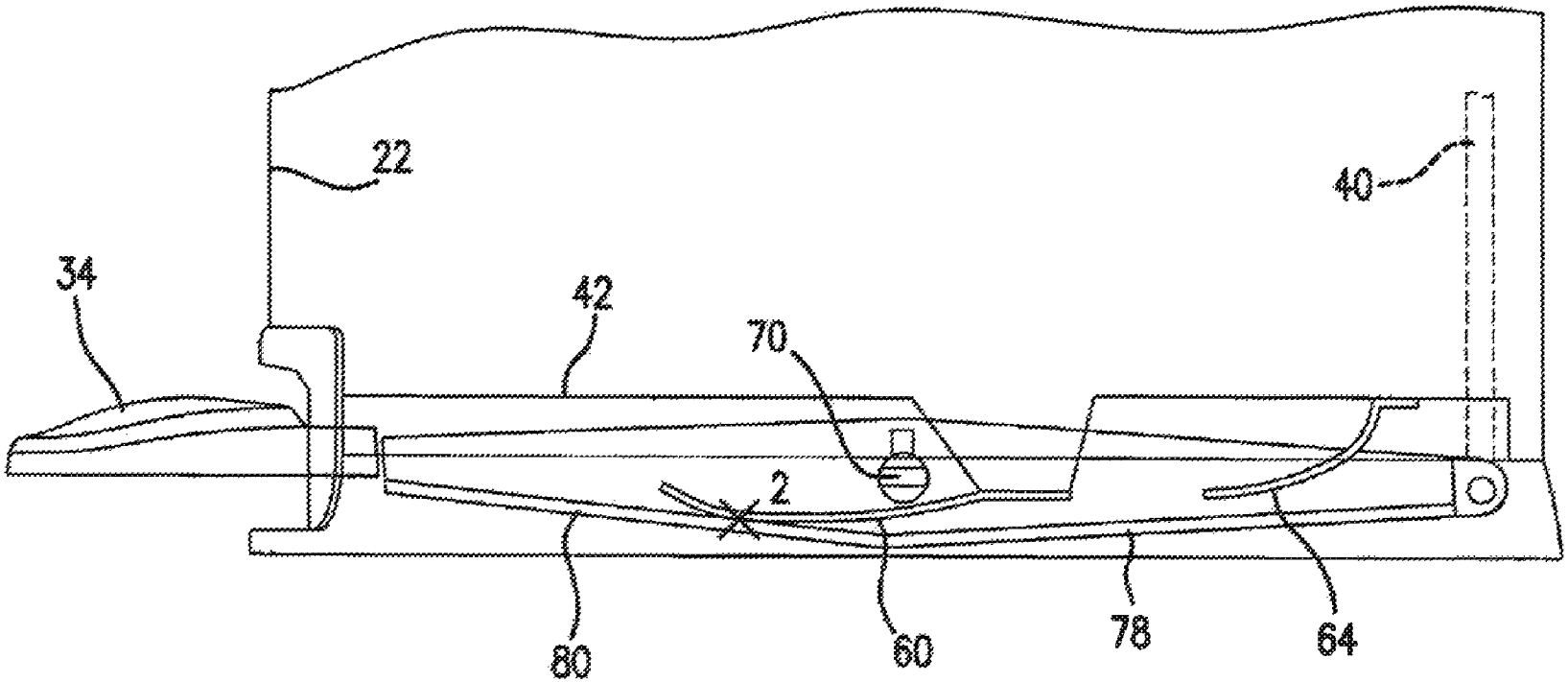

As the user continues to step on the pedal 34, the pedal bar 38 continues to pivot in the counterclockwise direction (when viewed from the orientation of FIGS. 7A-7E) about the pivot shaft 70 until the first elastic element 48 contacts the pedal bar 38 at the location marked "2" in FIG. 7C. At this time, the second elastic element 50 is still spaced apart from the rear portion 78 of the pedal bar 38.

Figure 7D:
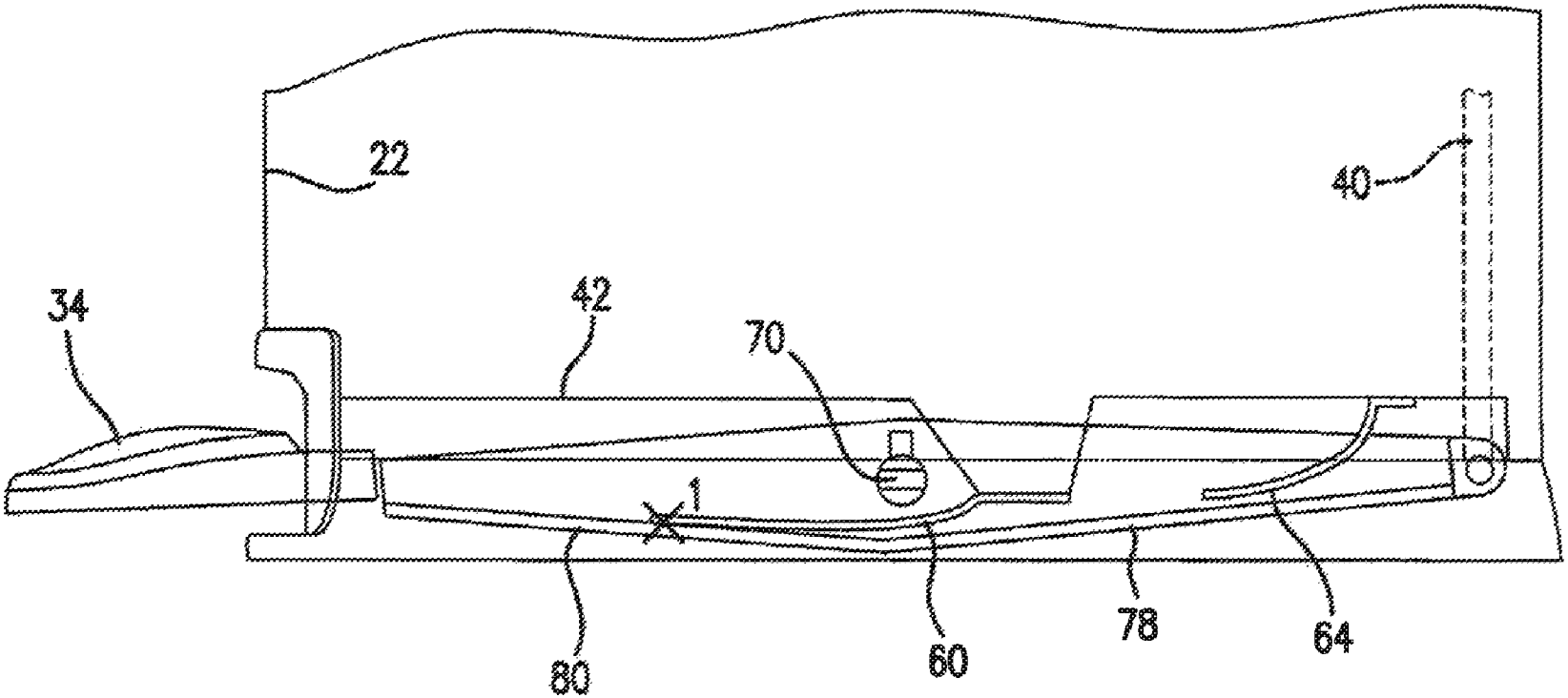
Figure 7E:
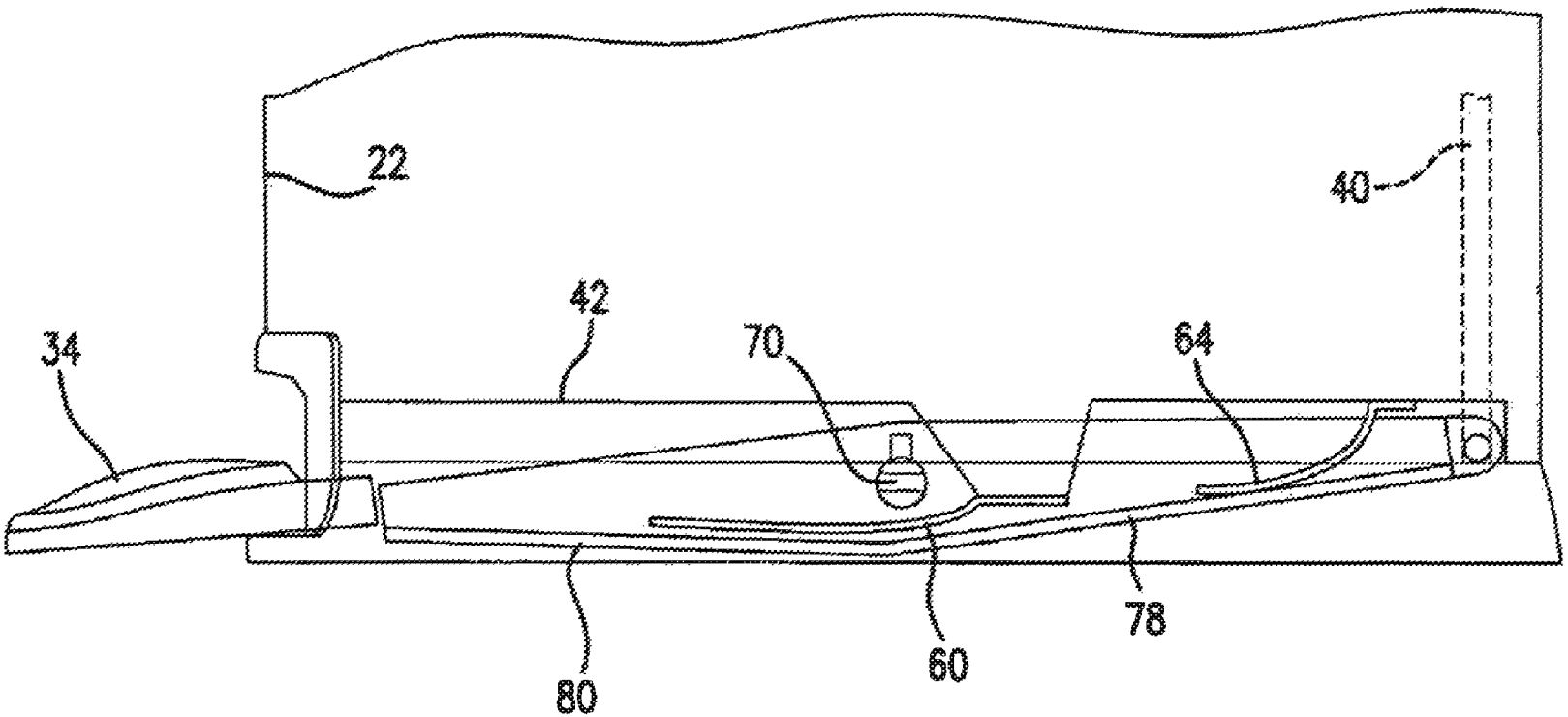

As the user continues to step on the pedal 34, the pedal bar 38 continues to pivot in the counterclockwise direction (when viewed from the orientation of FIGS. 7A-7E) about the pivot shaft 70 until the first elastic element 48 contacts the pedal bar 38 at the location marked "1" in FIG. 7D. At this time, the second elastic element 50 is still spaced apart from the rear portion 78 of the pedal bar 38.

When the pedal 34 has been pressed to its bottom-most position (see FIG. 7E), the front portion 80 of the pedal bar 38 is spaced apart from the curved portion 60 of the first elastic element 48. However, before the pedal 34 reaches its bottom-most position, the second elastic element 50 will have contacted the rear portion 78 of the pedal bar 38 to exert a bias against the rear portion 78, thereby damping the counter-clockwise motion of the rear portion 78, and subsequently, the opening of the lid 26.

When the user releases his or her step on the pedal 34, gravity and the weight of the lid 26 will cause the pedal bar 38 to begin to pivot in a clockwise direction (when viewed from the orientation of FIGS. 7A-7E) about the pivot shaft 70 until the first elastic element 48 contacts the pedal bar 38 at the location marked "1" in FIG. 7D. This location "1" is where the natural bias of the curved portion 60 would be the greatest. This because the bias is greatest at the location (i.e., "1") further from the pivot 70. Thus, the greatest bias is exerted against the pedal bar 38 to begin the damping of the beginning of the clockwise pivot of the pedal bar 38 to slow the closing of the lid 26. At this time, the second elastic element 50 will have been spaced apart from the rear portion 78 of the pedal bar 38.

As the pedal bar 38 continues to pivot in the clockwise direction (when viewed from the orientation of FIGS. 7A-7E) about the pivot shaft 70, the first elastic element 48 will contact the pedal bar 38 at the location marked "2" in FIG. 7C. At this location, the bias exerted by the curved portion 60 is less than at location "1", so a lesser bias is exerted against the pedal bar 38 to continue to dampen the clockwise pivot of the pedal bar 38. At this time, the second elastic element 50 is still spaced apart from the rear portion 78 of the pedal bar 38.

As the pedal bar 38 continues to pivot in the clockwise direction (when viewed from the orientation of FIGS. 7A-7E) about the pivot shaft 70, the first elastic element 48 will contact the pedal bar 38 at the location marked "3" in FIG. 7B. At this location, the smallest bias is exerted by the curved portion 60 (i.e., the bias at location "3" is less than at location "2") to provide minimal damping as the lid 26 closes. At this time, the second elastic element 50 is still spaced apart from the rear portion 78 of the pedal bar 38.

Thus, as best illustrated in FIGS. 7A-7E, the first elastic element 48 actually aids in the pivoting of the pedal bar 38 during the opening of the lid 26 (FIGS. 7A-7D), with the second elastic element 50 damping the opening motion at the very end (FIG. 7E) to prevent the lid 26 from experiencing a loud banging noise during the opening. During the closing of the lid 26, the first elastic element 48 applies the greatest amount of counterbalancing force against the pedal bar 38 at the beginning of the closing motion, and then applies a gradually decreasing amount of counterbalancing force against the pedal bar 38 during the closing motion, so as to provide a smooth closing motion for the lid 26.

Finally, the pedal bar 38 will pivot in the clockwise direction (when viewed from the orientation of FIGS. 7A-7E) about the pivot shaft 70 until it reaches the position shown in FIG. 7A, where the pedal 34 is at it highest vertical position.

For a conventional lid, the force of the lid 26 during its closing motion varies due to increased inertia and gain in momentum. This varying force causes the lid 26 to slam shut during a conventional closing action. To minimize this slamming effect, the first elastic element 48 functions as a variable counter-balance spring that matches the rate of the variable forces generated by the lid 26 as it closes. FIGS. 12A-12C illustrate the forces exerted by the lid 26 and the first elastic element 48 during the closing of the lid 26. FIG. 12A illustrates the lid 26 in its opened position, FIG. 12B illustrates the lid 26 halfway through its closing motion, and FIG. 12C illustrates the lid 26 completely closed.

Here, F.sub.r=the force applied to the link rod 40 as the lid 26 falls

F.sub.sc=the force needed to be generated by the first elastic element 48 to balance F.sub.r.

Here, F.sub.sc should be equal to or slightly less than F.sub.r. If F.sub.sc is greater than F.sub.r, the lid 26 will not close, and if F.sub.sc is significantly less than F.sub.r, the lid 26 will slam shut. In FIG. 12C, F.sub.r has the greatest force, and in FIG. 12A, F.sub.r has the smallest force. In addition: F.sub.r=T.sub.Lp/L.sub.rp where T.sub.Lp is the torque at the pivot axis of the lid 26, with T.sub.Lp being equal to the weight of the lid 26 multiplied by L.sub.cg, and where L.sub.rp is the length from the pivot point of the lid 26 to the pivot point of the link rod 40 (i.e., where the link rod 40 pushes the lid 26); and F.sub.sc=T.sub.pp/L.sub.sc where T.sub.pp is the torque at the pivot axis of the pedal bar 38, with T.sub.pp=F.sub.r.times.L.sub.pp, where L.sub.sc is the length of the pivot point of the pedal bar 38 to the point where the first elastic element 48 contacts the pedal bar 38, and L.sub.pp is the length of the pivot point of the pedal bar 38 to the pivot point of the link rod 40 (i.e., where the pedal bar 38 pushes the link rod 40).

As the force F.sub.r increases, so does the torque T.sub.pp. Therefore, the force F.sub.sc of the first elastic element 48 at the point where it contacts the pedal bar 38 needs to increase as well. This can be accomplished by proportionally varying L.sub.sa (the length of the first elastic element 48), so that as L.sub.sa decreases, the force of the first elastic element 48 at F.sub.sc increases. The profile or curvature of the first elastic element 48 is what determines the rate of change in L.sub.sa which then changes F.sub.sc, therefore a lid 26 of any size or weight can be balanced by the appropriate size and shape of the first elastic element 48.

Figure 9:
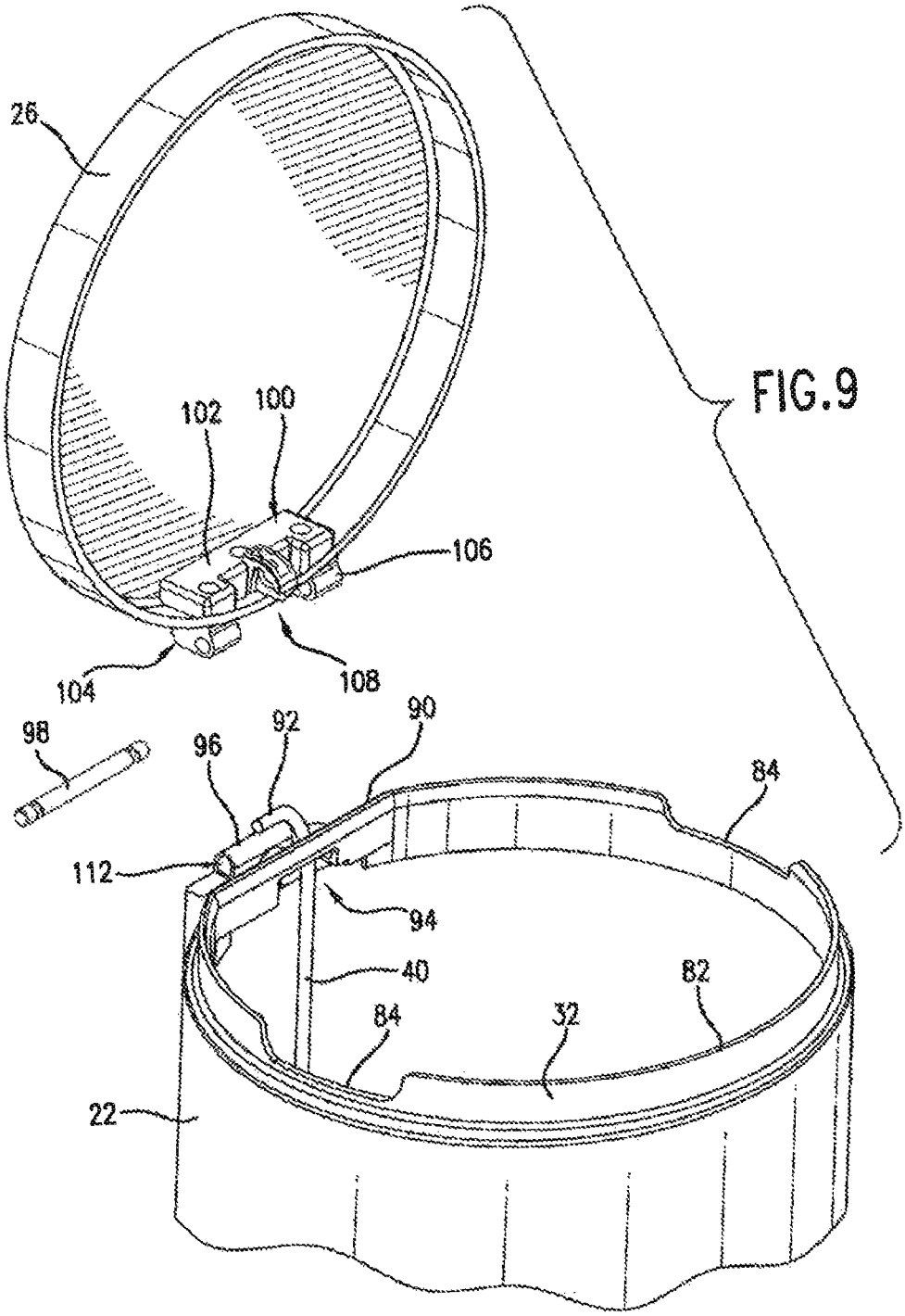
FIG. 9 is an exploded top perspective of the upper portion of the trash can assembly of FIG. 1.

Referring now to FIG. 9, the upper support frame 32 has a border or ridge 82 that extends along its inner periphery which is adapted to receive the upper lip (not shown) of the inner liner 24 so that the inner liner 24 can be suspended inside the outer shell 22 during use. A plurality of scalloped grooves 84 are spaced-apart about the support frame 32, and function to allow the user to insert his or her fingers into the grooves 84 under the upper lip of the inner liner 24 to lift the inner liner 24 from the interior of the outer shell 22 when the lid 26 is opened. This provides a convenient way for the user to remove the inner liner 24 from the outer shell 22, without requiring the user to grab or grip unnecessarily large portions of the inner liner 24.

Referring now to FIGS. 1-3 and 9-11, the hinge assembly 28 has a thin-profile housing 88 that is positioned adjacent the rear of the support frame 32. The rear of the support frame 32 has a straight portion 90 that extends into the interior of the outer shell 22. The inner liner 24 is also partially supported on the straight portion 90. An opening 94 is defined between the top of the outer shell 22 and the straight portion 90, so that the upper hooked end 92 of the link rod 40 can extend through the opening 94 and into the housing 88 of the hinge assembly 28, as explained below. By positioning the entire link rod 40 (including its upper hooked end 92) inside the periphery of the outer shell 22, the housing 88 of the hinge assembly 28 can be made to have a thinner profile. In turn, the entire link rod 40 can be positioned inside the periphery of the outer shell 22 because the straight portion 90 (and the opening 94) are positioned inside the interior of the outer shell 22.

The hinge assembly 28 also includes a mounting bracket 100 that is secured to the rear of the lid 26. The mounting bracket 100 has an internal bracket 102 that is secured to the interior of the lid 26, and an external bracket 104 that is secured to the exterior of the lid 26. The external bracket 104 has an outer profile that is preferably flush with the outer profile of the housing 88, as best shown in FIG. 2, to achieve the low-profile appearance for the entire hinge assembly 28. The top of the housing 88 has a channel 96 having a bore 112 through which a pivot bar 98 can be extended.

Figure 10:
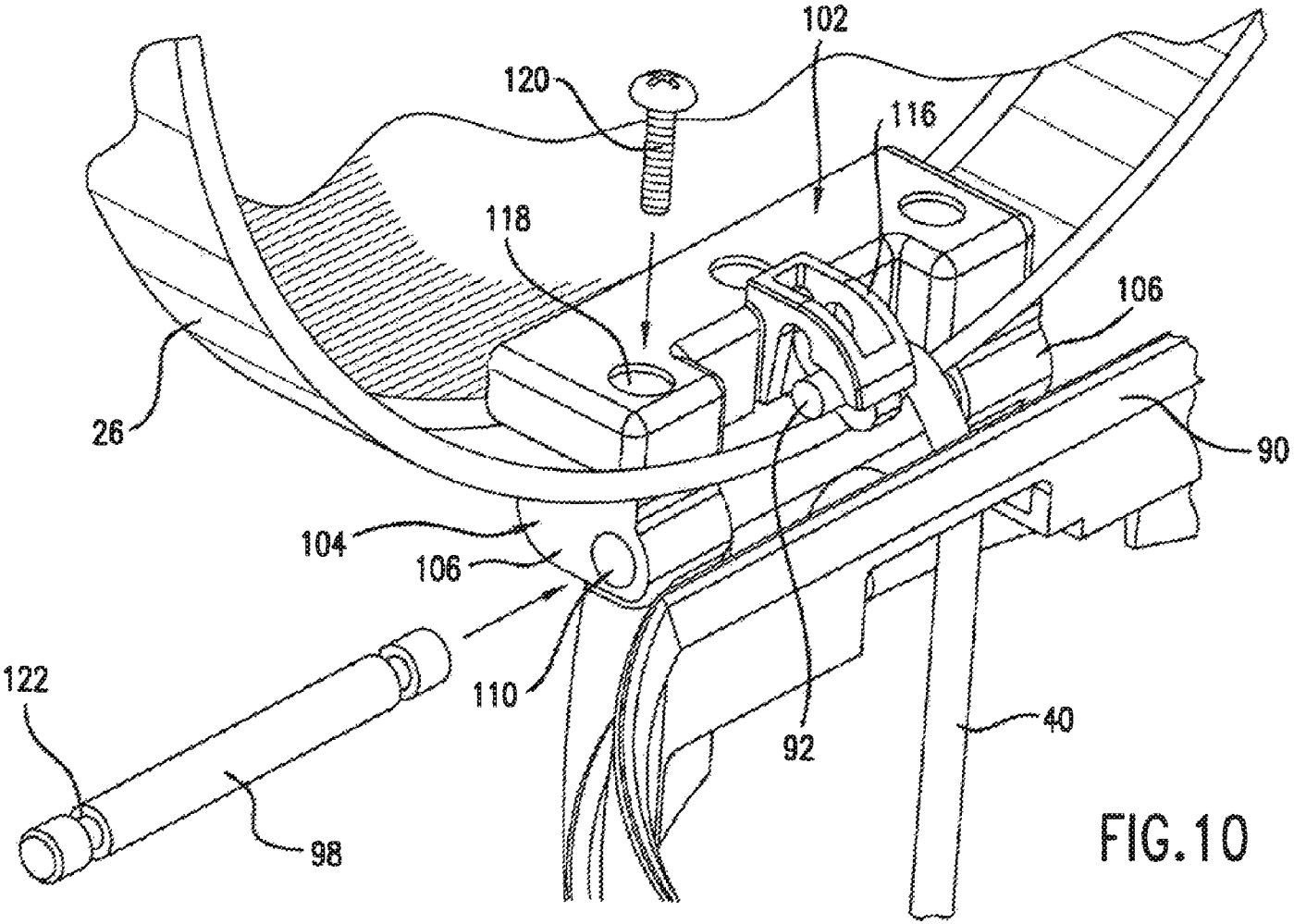
FIG. 10 is an enlarged and exploded perspective view of the hinge assembly of the trash can assembly of FIG. 1.
Figure 11:
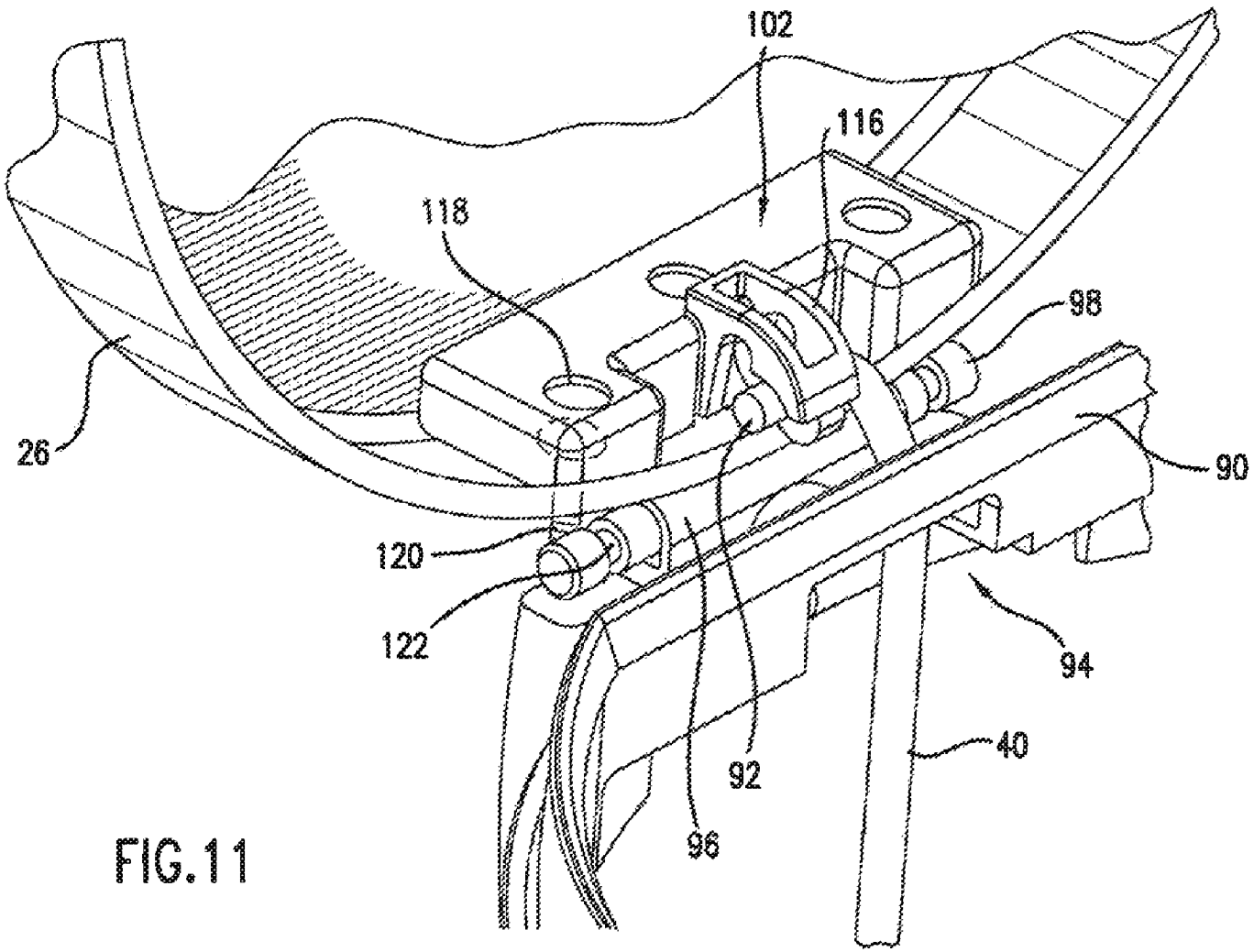
FIG. 11 is an enlarged perspective view of the hinge assembly of the trash can assembly of FIG. 1 shown without the external bracket of the mounting bracket.

Referring now to FIGS. 9-11, the external bracket 104 has two legs 106 that define an open space or slot 108 therebetween. The channel 96 on top of the housing 88 is adapted to be received inside the slot 108. Each leg 106 also has a through-hole 110 that is aligned with the bore 112 of the channel 96, so that the pivot bar 98 can be received for pivot motion inside the through-holes 110 and the bore 112, while simultaneously achieving a pivoting connection between the channel 96 (and hence the housing 88) and the external bracket 104 (and hence the mounting bracket 100).

The internal bracket 102 has an extension 116 which has a slot that receives the hooked end 92 of the link rod 40 in a manner such that the hooked end 92 can pivot. In addition, a transverse bore 118 extends through the internal bracket 102, the flange of the lid 26, and a portion of one leg 106 of the external bracket 104, and communicates with the through-hole 110 in the leg 106. Thus, a locking bolt 120 can be threaded through the transverse bore 118 and contact the pivot bar 98 along an annular groove 122 thereof so as to lock the pivot bar 98 in a fixed position inside the bore 112 and the through-hole 110. This functions to secure the lid 26 to the housing 88 in a manner that allows the lid 26 to pivot about the pivot axis defined by the pivot bar 98.

The lid 26 can be removed quickly and conveniently. To remove the lid 26, the user merely removes the bolt 120, and then uses a thin element (e.g., a pen or a rod) to pry the pivot bar 98 from the bore 112 and the through-holes 110. The lid 26 (i.e., the external bracket 104) can then be separated from the outer shell 22 (i.e., the channel 96 of the housing 88). The lid 26 (or a new lid 26) can be installed just as quickly and conveniently by fitting the channel 96 inside the slot 108 and then sliding the pivot bar 98 through the through-holes 110 and the bore 112. The bolt 120 can then be inserted through the transverse bore 118 (see FIG. 10) so that a portion of the bolt 120 is lodged inside the groove 122 of the pivot bar 98 (see FIG. 11), thereby securing the pivot bar 98 at a fixed location inside the through-holes 110 and the bore 112.

The structure of all the components of the hinge assembly 28 allow for the reduced profile of the hinge assembly 28. For example, as best shown in FIGS. 9-11, portions of the brackets 102, 104 are positioned inside the interior of the outer shell 22, thereby allowing the pivot axis of the lid 26 (defined by the pivot bar 98) to be positioned inside the interior of the outer shell 22. In addition, as explained above, positioning the straight portion 90 inside the interior of the outer shell 22 allows the entire link rod 40 to be located inside the outer shell 22 to further facilitate positioning the pivot axis of the lid 26 (defined by the pivot bar 98) inside the outer shell 22.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having an upper, open end;

a lid configured to cover the upper, open end of the shell;

a hinge assembly coupled to the shell and the lid, configured to permit selective removal of the lid, and configured to provide pivotable movement of the lid between an open position and a closed position, wherein the hinge assembly comprises, a mounting bracket provided on the lid and having at least one through hole, a housing provided at the upper end of the shell and defining a bore, and a removable pivot bar that is received inside the at least one through hole and the bore to allow pivotable movement of the mounting bracket relative to the housing, and engaged by a locking mechanism into a position within mounting bracket and housing to prevent withdrawal of the removable pivot bar from inside the at least one through hole and the bore, and wherein the pivot bar is removable through either side of the bore based on exertion of force to release engagement of the locking mechanism.

2. The assembly of claim 1, wherein the shell is oval.

3. The assembly of claim 1, wherein the shell is circular.

4. The assembly of claim 1, wherein the shell is multi-sided.

5. The assembly of claim 1, wherein the locking mechanism is a locking bolt that extends through a portion of the mounting bracket and wherein the mounting bracket includes a transverse bore through which the locking bolt is extended.

6. The assembly of claim 1, wherein the shell is at least partially constructed from a metal.

7. The assembly of claim 1, wherein the shell is at least partially constructed from a plastic.

8. The assembly of claim 1, wherein the lid is at least partially constructed from a metal.

9. The assembly of claim 1, wherein the lid is at least partially constructed from a plastic.

10. The assembly of claim 1 further comprising a pedal pivotably coupled to a base of the shell and coupled to the hinge assembly.

11. The assembly of claim 10, wherein the pedal is at least partially constructed from a metal.

12. The assembly of claim 10, wherein the pedal is at least partially constructed from a plastic.

* * * * *